United States Patent [19]

George

[11] Patent Number: 4,637,478

[45] Date of Patent: Jan. 20, 1987

[54] GRAVITY ORIENTED PERFORATING GUN FOR USE IN SLANTED BOREHOLES

[75] Inventor: Flint R. George, Houston, Tex.

[73] Assignee: Halliburton Company, Duncan, Okla.

[21] Appl. No.: 763,108

[22] Filed: Aug. 7, 1985

Related U.S. Application Data

[63] Continuation of Ser. No. 436,075, Oct. 20, 1982, abandoned.

[51] Int. Cl.[4] ..... E21B 43/117

[52] U.S. Cl. ..... 175/4.51; 175/4.51; 166/55.1

[58] Field of Search ..... 175/4.51, 4.54, 4.6, 175/45; 166/55.1, 55, 297; 102/317, 320, 322, 321, 310–313

[56] References Cited

U.S. PATENT DOCUMENTS

| | | | |
|---|---|---|---|
| 2,866,508 | 12/1958 | Church | 166/55 |
| 3,100,443 | 8/1963 | Pohoriles | 102/20 |
| 3,426,850 | 2/1969 | McDuffie, Jr. | 175/4.51 |
| 3,951,218 | 4/1976 | Sjogren | 175/4.6 |
| 4,105,073 | 8/1978 | Brieger | 166/286 |
| 4,153,118 | 3/1977 | Hart | 175/4.51 |
| 4,194,577 | 3/1980 | Vann | 175/4.51 |
| 4,410,051 | 10/1980 | Daniel et al. | 175/4.56 X |

*Primary Examiner*—Stephen J. Novosad
*Assistant Examiner*—Thomas J. Odar
*Attorney, Agent, or Firm*—James R. Duzan

[57] ABSTRACT

The present invention includes a gravity oriented perforating gun for use downhole in a slanted borehole. The center of gravity of the gun is located relative to the charge carrier and to a journal means to cause the charge carrier to rotate by gravity about the longitudinal axis of the gun into a predetermined relative position. A plurality of the spaced journal means support the charge carrier in low friction relationship relative to the wellbore. The individual shaped charges gravitate into a position which orients the direction of penetration to occur in a downward direction. Accordingly, production must occur in an upwardly direction through the perforations and into the slanted borehole, thereby reducing flow of formation particles into the borehole.

11 Claims, 12 Drawing Figures

FIG. 1
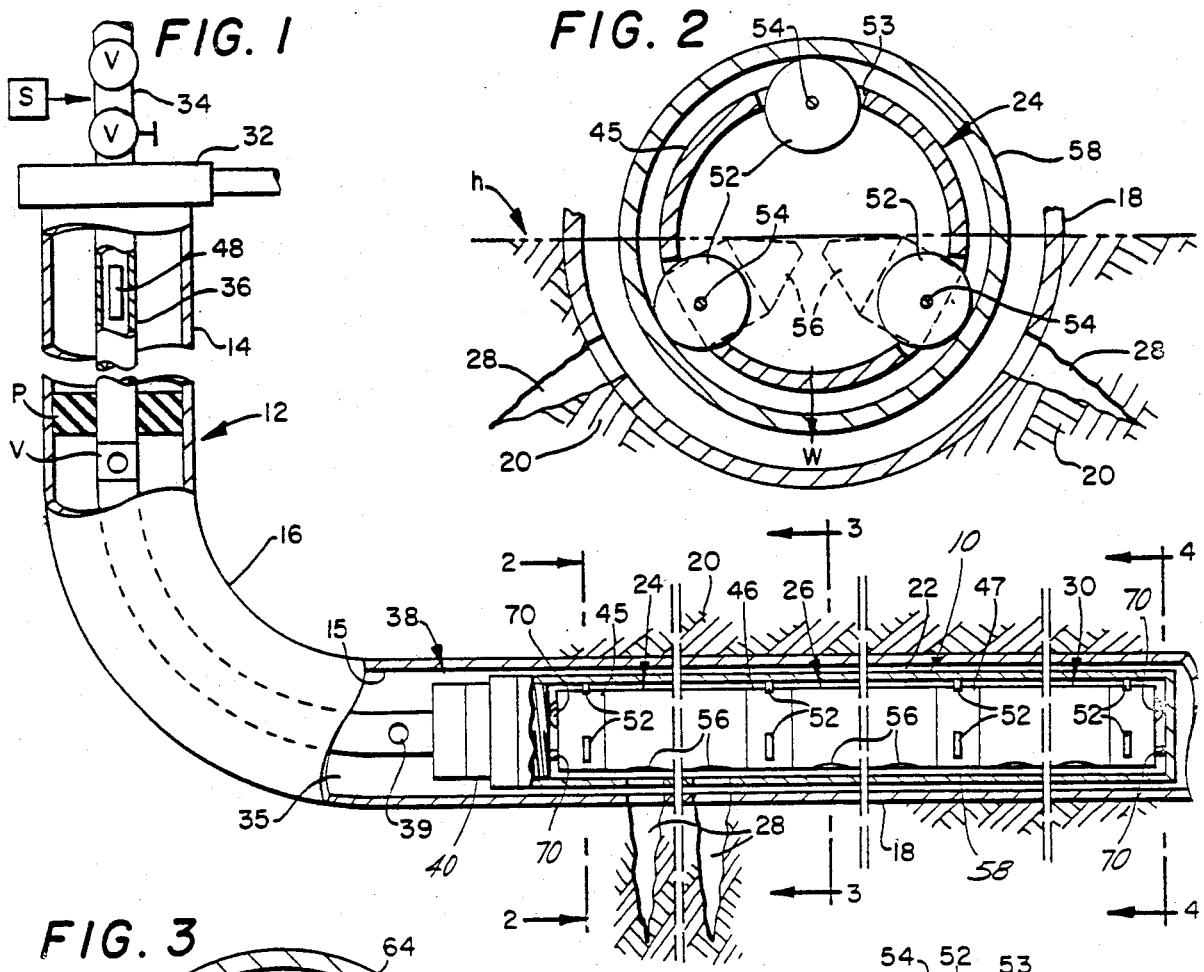
FIG. 2
FIG. 3
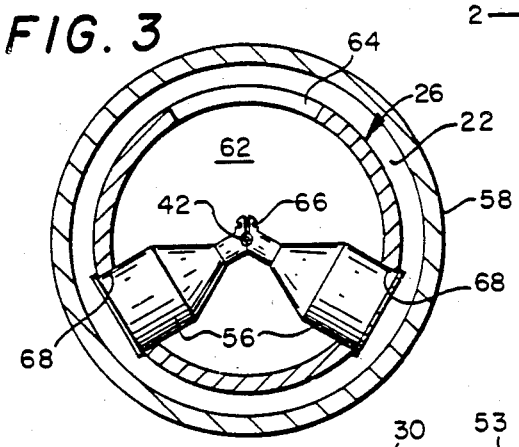
FIG. 4
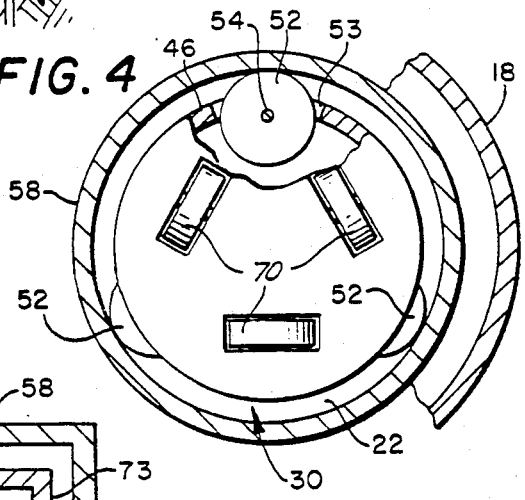
FIG. 5
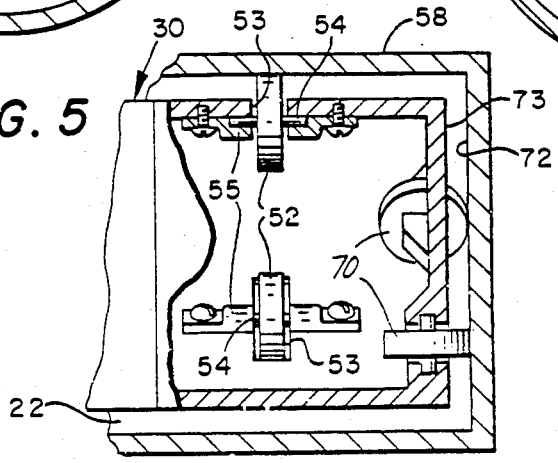

GRAVITY ORIENTED PERFORATING GUN FOR USE IN SLANTED BOREHOLES

This application is a continuation of application Ser. No. 436,075, filed Oct. 20, 1982 now abandoned.

BACKGROUND OF THE INVENTION

In prior art systems where a plurality of perforating guns are connected in tandem to perforate a substantial length of a cased deviated borehole, it is necessary to align each of the perforating guns with adjacent perforating guns in the string to insure that the predetermined pattern of perforations is properly oriented within the deviated borehole. If the perforating guns are not all properly oriented with respect to each other, the perforation pattern will not be oriented in the proper direction within the cased borehole because one or more of the perforating guns is oriented in the wrong direction Although swivels can be used between adjacent perforating guns in a prior art perforating gun string, it is necessary that the swivels be watertight. Since the prima cord extends from the lowermost gun to the uppermost gun, the string of perforating guns must be hermetically sealed to prevent water from entering the gun string and damage the prima cord causing it to fail to detonate all of the guns. Further, it is necessary that packing be applied around the prima cord to keep it dry. In a long string of perforating guns, it is undesirable for the prima cord to bind or be subject to pressure and friction from the packing of the prima cord connections between adjacent guns.

Other alignment systems for perforating guns include the rotation of the perforating gun within the cased borehole. Since the cased borehole is filled with well fluids such as mud, it is necessary that the perforating gun be subjected to this well fluid environment. Since the alignment system is subjected and exposed to well fluids, there is a possibility that the well fluids will hinder the proper alignment of the charges within the cased borehole.

The art of drilling a slanted borehole is being utilized to a much greater extent in recent years, as evidenced by U.S. Pat. No. 4,194,577, to which reference is made for further background of this invention.

In U.S. Pat. No. 4,194,577 and patent application Ser. No. 166,547 filed July 7, 1980, there is set forth a gravity oriented perforating tool. The gun has a radially extending guide means which contacts the inside peripheral wall of the casing and forces the gun into a substantially upright position. In some wells which are slanted at a substantial angle with respect to the horizontal, the gravitational forces are insufficient to overcome the frictional forces required to orient the before-mentioned perforating gun into a position whereby the shaped charges will fire downwardly in the desired direction for perforating the casing in a downward direction.

When the casing of a highly deviated borehole is perforated radially in all directions, some of the production occurs downwardly from the formation into the slanted portion of the borehole, thereby washing formation particles into the borehole, which is especially undesirable in unconsolidated formations. Therefore, it is desirable to have made available a low friction means by which the charge carriers of a perforating gun are journaled in low friction relationship with respect to the borehole so that reduced gravitational forces are required to orient the gun into a position whereby the shaped charges, when detonated, fire predominantly downwardly, thereby perforating the wellbore in a predominantly downward direction, whereupon production must then occur upwardly from the formation into the slanted part of the borehole.

Method and apparatus which achieves the above desirable goal is the subject of the present invention.

REFERENCE TO THE PRIOR ART

U.S. Pat. No. 4,194,577 and to the art cited therein; U.S. Pat. Nos. 3,706,344; and 3,931,855.

SUMMARY OF THE INVENTION

This invention comprehends a gravity oriented perforating gun for use downhole in a slanted borehole, which is gravity oriented into an upright position so that when the shaped charges thereof are detonated, the wellbore is penetrated in a predominantly downward direction, whereupon production must occur upwardly from the formation into the slanted part of the borehole.

The gun includes a charge carrier having a plurality of shaped charges mounted therein, with the individual charges being oriented with respect to one another to discharge radially away from the gun within an angle of divergence of less than 180° relative to one another. Journal means supports the charge carrier for rotation about the longitudinal axial centerline thereof when the charge carrier is lowered into position within the borehole. Said journal means is positioned relative to the charge carrier such that the center of gravity of the charge carrier gravitates the shaped charges into a position whereby the shaped charges are oriented to fire in a predominantly downward direction.

A firing head for detonating the shaped charges is included at the upper end of the gun. A gun firing head is connected to a tubing string so that a gun firing device can be run downhole through the tubing string into contact with the gun firing head, thereby detonating the shaped charges of each charge carrier.

An object of this invention is the use of the above apparatus to enable a method of perforating a slanted borehole to be carried out as set forth in the appended claims Another object of the present invention is the provision of a method by which a slanted borehole can be perforated in a predominantly downward direction Still another object of the present invention is the provision of a gravity oriented apparatus by which a slanted borehole can be perforated in a predominantly downward direction.

A further object of this invention is the provision of journal means by which the charge carrier of a jet perforating gun is supported in low friction relationship with respect to a borehole, and the distribution of the mass of the gun is such that the shaped charges are always oriented in a downward direction.

Another and still further object of the present invention is the provision of apparatus by which shaped charges of a gun are supported in low friction relationship with respect to a borehole so that when the gun is run downhole into a slanted part of a borehole, the shaped charges are gravity oriented to fire in a downward direction.

Another object of the present invention is to house the rotating charge carrier and orientation device in air or other clean, dry environment rather than a well-fluid environment.

Another object of the present invention is to house the charge carrier in a substantially friction-free environment where the center of mass in the charge carrier is subjected to gravity whereby the charge carrier will gravitate to a predetermined position prior to detonating the perforating gun.

Still another object of the present invention is the provision of individual alignment means for each charge carrier whereby the alignment of one charge carrier is not dependent upon the alignment of any other charge carrier in a string of perforating guns.

A further object of the present invention is the provision for free movement of the charge carrier within the housing of the perforating gun as the perforating gun is lowered into the well, such that once the perforating gun is in position, the center of gravity of the charge carrier properly orients the charges within the cased borehole.

Another object of the present invention is the provision of a free floating charge carrier which is properly oriented within the cased borehole without regard to the torque placed on the tubing string or the direction in which the perforating gun is moved within the well.

A further object of the present invention is the provision of a prima cord connection between adjacent charge carriers whereby the prima cord in one charge carrier is permitted to rotate with respect to the adjacent prima cord in another charge carrier and yet provide reliable detonation.

Another object of the present invention is the provision for independent movement of the charge carrier within the gun housing whereby the prima cord is not tied to the housing.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

BRIEF DESCRIPTION OF THE DRAWINGS

FIG. 1 sets forth a vertical, cross-sectional view of part of the earth showing apparatus made in accordance with the present invention associated therewith, with some parts thereof being broken away therefrom, and some of the remaining parts being shown in cross section;

FIG. 2 is an enlarged, broken, part cross-sectional view taken along line 2—2 of FIG. 1;

FIG. 3 is an enlarged, part cross-sectional view taken along line 3—3 of FIG. 1;

FIG. 4 is an enlarged, part cross-sectional view looking in the direction indicated by line 4—4 of FIG. 1;

FIG. 5 is an enlarged, detailed, fragmented, part cross-sectional view of part of the gun device disclosed in FIG. 1;

DETAILED DESCRIPTION OF THE PREFERRED EMBODIMENTS

Figure 6:
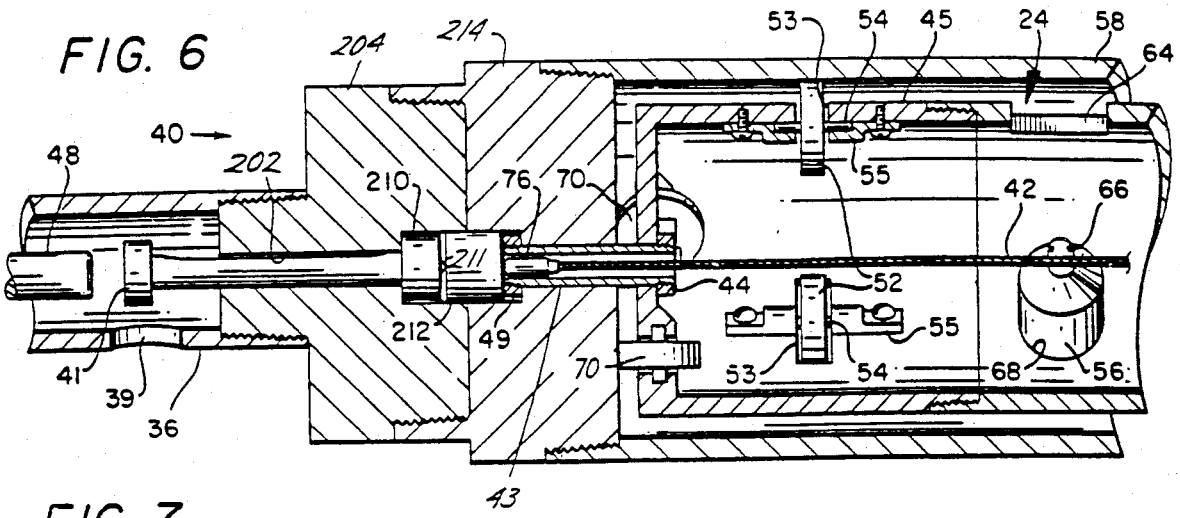
FIG. 6 is a detailed, enlarged view of part of the apparatus disclosed in FIG. 1.

In the figures of the drawings, there is disclosed a gravity oriented perforating gun 10 made in accordance with the present invention. As seen in FIG. 1, the gun preferably is located downhole in a slanted portion of a highly deviated borehole 12, which usually is cased as noted by numeral 14. The borehole may extend from less than one hundred to several thousand feet vertically and then is deliberately turned at 16 into a substantially horizontal part 18, through a production formation 20. The deviation at 16 shown in FIG. 1 is schematic, and generally the deviation from vertical to horizontal will occur over a borehole length of a few thousand feet. Thus, there is no tendency for the pipe string and perforating gun to bind within the cased borehole 12 as it passes from vertical to a more horizontal position. It is possible through the use of U-point connections or universals to pass from vertical to horizontal in a distance of 300 feet. The term "slanted part of a borehole" is intended to mean a portion of the borehole which has been deliberately curved back towards the surface of the earth, but not necessarily 90° all the way back to the horizontal, but which is sufficiently slanted in a known direction to enable the practice of the present invention to be carried out.

Gun 10 includes a housing 58 with an overall diameter smaller than the inside diameter 15 of casing 14 so that there is always sufficient space at 22 between the wall 15 of the casing 14 and the outer surface of housing 58 of gun 10 to enable the gun 10 to be freely telescopingly received therein. The gun 10 includes a plurality of charge carriers 24 and 26 series connected together along a common longitudinal axial centerline and disposed within housing 58. The housing 58 with charge carriers 24, 26 are arranged adjacent to the formation 20 to form perforations 28 in a downward direction into the hydrocarbon-containing formation 20. Housing 58 and charge carriers 24, 26 are preferably tubular but may be of any shape Other charge carriers 30 can be included into the string of guns so as to attain the desired number of perforations into the payzone of formation 20. The present invention permits a gun string having a length over 1,000 feet.

The wellbore 12 usually includes a wellhead 32 having a lubricator 34 connected thereto for controlling flow through a production tubing 36. The lower end of the tubing 36 is connected to a sub 38, the details of which are diagrammatically set forth in FIG. 6

Port 39 of FIGS. 1 and 6 is formed near the gun firing head 40, the details of which may be made in accordance with U.S. Pat. No. 3,706,344. The gun firing head 40 includes trigger or firing pin member 41 which is slidably received in an axial bore 202 of a sub 204 and has a hammer end 210 provided with a firing point 211. The firing point 211 is engageable with an explosive device 212 which is positioned adjacent the booster cap 76 attached to the end of the prima cord 42. Thus means are provided to detonate prima cord 42 when member 41 is impacted by a falling bar such as seen at 48 in FIGS. 1 and 6. Connections 43, 44 and 49 of FIG. 6 isolate the prima cord from possible injury while passing through the journal means housed in subs 45, 46 and 47 of FIG. 1 and 45 of FIG. 6.

The spaced journal means housed in subs 45, 46, and 47 and seen in FIG. 1, supports and connects the charge carriers 24, 26, 30 respectively, through housing 58 and thus the wellbore 12. Subs 45–47 form low friction orienting devices and are indexed with respect to one another and to the individual charge carriers 24, 26, 30 so that the shaped charges supported by each of the charge carriers 24, 26, 30 are oriented in the housing 58 of gun 10 in like or similar directions, preferably in the illustrated manner of FIGS. 2, 3, 6, 9, 11, and 12.

The charge carriers 24, 26, 30 preferably are hermetically sealed within housing 58, in the illustrated manner of FIGS. 1–5, the end of the housing 58 being closed by a cap 214, shown in FIG. 6, thereby protecting the journal means and shaped charges from well fluids.

Figure 7:
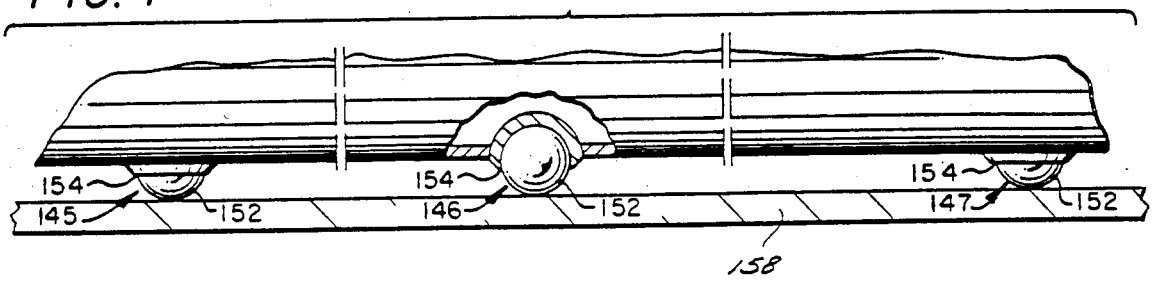
FIG. 7 diagrammatically sets forth a modification of part of the apparatus disclosed in FIG. 1.

As seen illustrated in FIGS. 5–7, a typical journal means comprises circumferentially spaced wheels 52 or balls 152. Referring initially to FIGS. 5 and 6, wheels 52 are received within a lateral slot 53, with a wheel axle 54 being attached at 55 to the charge carrier. The wheels 52 preferably are in groups of three, spaced 120° apart, and lie in a common plane in radially spaced relationship in the illustrated manner of FIGS. 2, 4, 5, 6, 9, 11, and 12 of the drawings. Although subs 45–47 with wheels 52 may be located anywhere along the length of a particular charge carrier without regard to the location of charges 56, it is preferred that there be at least three wheels 52 in a common plane with three sets of three wheels along the length of the charge carrier whereby there would be nine wheels mounted on the periphery of the charge carrier and at least one wheel on the lowermost end of the charge carrier. The placement of the shaped charges 56 within the charge carrier dictates the location of the wheels 52 on the charge carrier.

Figure 9:
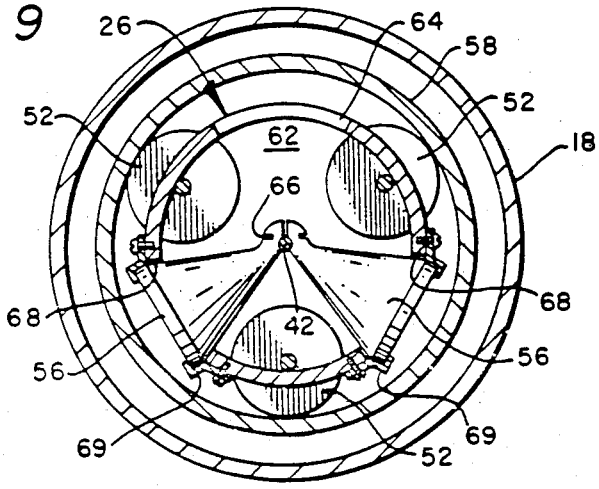
FIG. 9 sets forth an alternate embodiment of the apparatus disclosed in FIGS. 1-6.
Figure 10:
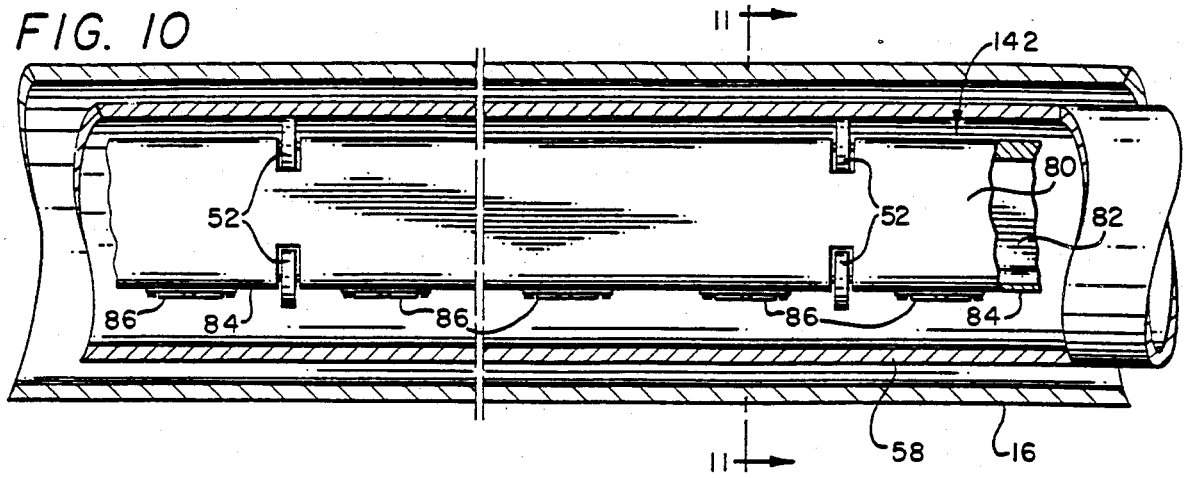
FIG. 10 is a longitudinal, part cross-sectional view of another alternate embodiment of the present invention.

A plurality of shaped charges 56 shown in FIGS. 1, 3 and 6 are secured by conventional means within the charge carriers 24, 26, 30 with the charges 56 each being oriented to be directed radially away from the centerline of the charge carrier and in a downward direction, i.e., a direction below the horizontal. Each charge carrier 24, 26, 30 is received in low friction, journaled relationship within the housing 58 which isolates the interior of the gun 10 from any well fluids. The housing 58 has a diameter to be telescopingly received within the borehole casing 14, with the wheels 52 of charge carriers 24, 26, 30 being engaged with the interior of the housing 58. As best shown in FIG. 9, there is a small clearance between wheels 52 and the interior of housing 58. It is not intended that charge carriers 24, 26, 30 have excessive movement within housing 58. It is preferred that the longitudinal axis of the charge carriers be substantially the same as that of housing 58.

The interior 62 of the charge carrier of FIGS. 3 and 9 is accessible through a window 64. Window 64 is used for assembling the shaped charges within the charge carrier and for installing prima cord 42. Window 64 also forms a lightening hole and moves the center of gravity of each of the charge carriers 24, 26, 30 further below the geometrical center thereof.

The shaped charges 56 of FIG. 9 have the apexes thereof specially contoured to be secured together by a wire fastener 66, with the outer conical wall of the shaped charge being abuttingly received within a complementary contoured port 68. Clips 69 rigidly secure the shaped charges within the charge carrier ports 68.

The lowermost charge carrier 30 of FIG. 5 includes end thrust bearings in the form of wheels 70. The wheels 70 bear against a closure member 72 formed at the lower end of housing 58. Wheels 70 maintain end wall 73 of the charge carrier 30 in spaced relationship with respect to end wall 72 of the housing 58, so that as the borehole 12 slants away from horizontal, the wheels 70 bottom support the charge carrier 30 in low friction relationship with respect to the housing 58.

Similarly, the upper end of the uppermost charge carrier 24 is provided with wheels 70 for low friction engagement of the charge carrier 24 with the cap 214 when the borehole slants upwardly.

In FIG. 7, the journal means comprises balls 152 engaging the interior of housing 158 of gun 10. The balls 152 are captured within a housing or retainer 154 and arranged in radially spaced relationship with respect to one another. Balls 152 may be preferred over wheels 70 since balls 152 are easier to assemble than wheels 70. Further, balls 152 may be located anywhere along the length of subs 145, 146, 147 and are not located on such subs with particular respect to the disposition of any of the charges within those subs.

Figure 8:
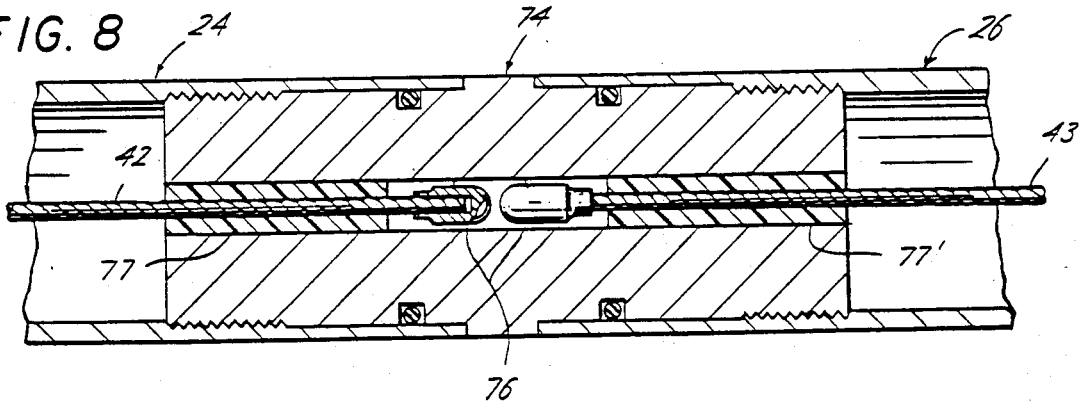
FIG. 8 is a fragmented, part cross-sectional view which sets forth additional details of the present invention.

FIG. 8 illustrates the connection between charge carriers 24 and 26. A tandem sub 74 is disposed between carriers 24, 26 which provides swivel means between the adjacent ends of two lengths of prima cord 42, 43. Prima cord 42 extends into sub 74 from charge carrier 24 and prima cord 43 extends into tandem sub 74 from charge carrier 26. Booster caps 76 are attached to the marginal portion of the adjacent ends of prima cords 42, 43, and are telescopingly received within Teflon conduits 77, 77'. The adjacent ends within explosive booster caps 76 are permitted to rotate within conduits 77, 77' relative to each other. The swivel means can also be employed at the connection shown in FIG. 6 between the firing pin 41 and the first charge carrier 24 of the perforating gun. Thus, since the adjacent ends of the prima cord are not connected together, they are permitted to rotate with respect to each other and yet the boosters on the ends of the prima cord are able to pass the detonation signal from one charge carrier to another. The Teflon conduits 77, 77' assists in permitting the ends of prima cord 42, 42' to rotate therewithin.

Figure 11:
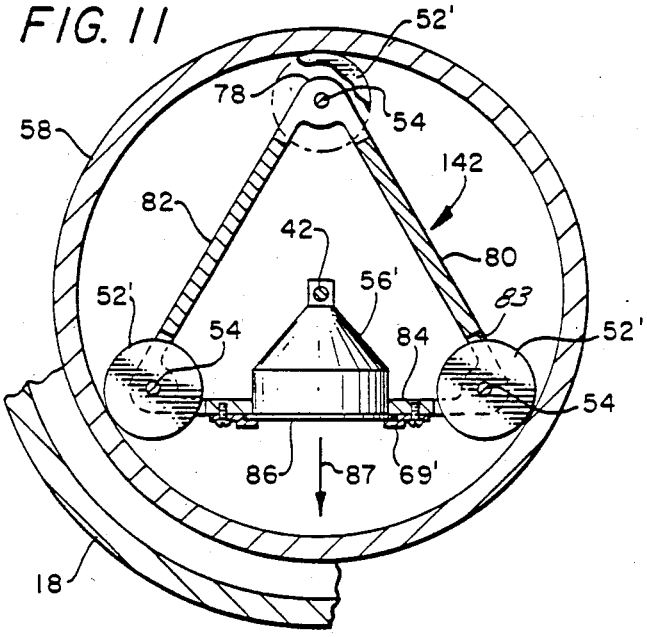
FIG. 11 is an enlarged, cross-sectional view taken along line 11—11 of FIG. 10; and, FIG. 12 sets forth an alternate embodiment of the apparatus disclosed in FIGS. 10 and 11.

In FIG. 11, the charge carrier 142 is seen to be in the form of a triangle having an upper apex at 78. The triangle includes opposed adjacent sidewalls 80, 82, and 84. Wheels 52' are connected at each apex of the triangle by axles 54 carried by the triangle corners. A lateral slot such as at 83 is formed within the adjacent walls 80, 82 and 84 for receiving the wheels 52' in low friction journaled relationship therewith.

Shaped charges 56' each have an outermost circumferentially extending flange 86 which is abuttingly received by the outer wall surface of lower wall 84. Clips 69' urge the shaped charge flange 86 into abutting engagement with wall 84. The prima cord 42 is received within the apertured end formed at the inner marginal terminal end of the shaped charges 56'. Numeral 87 indicates the line of penetration expected from the detonated shaped charge 56'.

Figure 12:
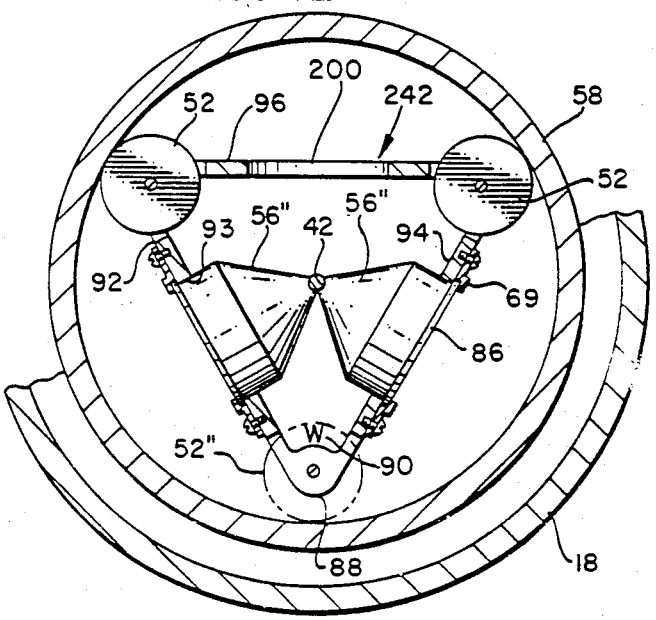

In FIG. 12, the apex 88 of the triangle is pointed downward so as to present most of the weight of the charge carrier 242 upon a lowermost single wheel 52''. Lower apex 88 has a weight 90 included at the lowermost portion thereof so as to move the center of gravity of the charge carrier 242 well below the geometrical center of the charge carrier 242. The center of gravity of the charge carrier is located to insure that the charge carrier stays in the oriented position. The lower half of the charge carrier is substantially heavier than the upper half to insure such orientation. As shown in FIG. 12, it is generally preferred to have two adjacent charges facing downwardly.

Sidewalls 92, 94, and 96 form the triangular charge carrier, with walls 92 and 94 having an aperture such as at 93 formed therethrough for receiving the shaped charges 56'' therein in the same or similar illustrated manner of FIG. 11. Sidewall 96 has an access hole 200 formed therein to enable access into the interior of the triangular body. The adjacent shaped charges 56'' diverge 120° relative to one another and penetrate the housing 58 and casing 14 of the wellbore 12 in a downward direction.

In operation, the shaped charges are mounted within the charge carrier and arranged relative to one another to cause the explosive blast therefrom to be directed in a downward direction as illustrated in either FIG. 2, 9, 11, or 12. The charge carrier will adjust and ride inside the housing of the perforating gun as the gun is passed down into the well. Although it is not contemplated that the charge carrier will make complete revolutions inside the housing, such movement is permitted since adjacent ends of the prima cords between charge carriers are not rigidly mechanically connected whereby there is no possibility for the prima cord to twist at such connection. The charge carrier preferably is either cylindrical or triangular, and may be housed within the illustrated enclosure, with the charges thereof connected to a gun firing head 40. A tubing string 36 is connected to the gun firing head 40 by means of a suitable sub and the entire tool string is then run downhole until the shaped charges are located within the payzone 20. As the string of perforating guns is lowered into the well, the charge carriers will seek the predetermined orientation within the cased borehole by gravity causing the charge carrier to rotate until the center of gravity of the charge carrier is in the proper oriented position. Since the charge carrier is within a housing, the charge carrier is permitted to rotate in an air environment and is not subject to exposure or influence by fluids. This permits the present invention to provide a more reliable orientation of the charges within the cased borehole. Instead of being rigidly connected together, adjacent charge carriers may be relatively rotatably connected by any well-known method without the necessity of any joint alignment therebetween. Adjacent charge carriers would therefore be independent of each other with respect to orientation.

The shaped charges assume the illustrated position of FIG. 3, 11, or 12 so as to be oriented to penetrate in a downward direction, that is, along a path 28 which is downwardly inclined with respect to the horizontal of FIG. 2. The firing pattern for all of the charges should therefore encompass less than 180 degrees.

The lubricator 34 is opened and a bar 48 dropped downhole and thereafter circulated through the tubing string 36 into abutting engagement with the gun firing head 40. This is accomplished by flowing fluid from fluid source S, down the tubing string 36, through port 39, up the annulus 35, and out of the wellhead 32. The flowing fluid carries the weight 48 downhole at a sufficient velocity to create an impact force against member 41 of a magnitude to actuate the gun firing head 40 which detonates prima cord 42. This action sequentially explodes all of the shaped charges, thereby perforating the casing.

Production from payzone 20 occurs upwards along tunnels 28, into the perforated casing 15, up the annulus 35, and out of the wellhead at 32. After the well has been cleaned up, the well can be shut-in, the gun 10 can be removed from the well, and a permanent packer installed in the borehole 12 on a production string.

Alternatively, the well is permanently completed by employing a packer device P and vent assembly V so that completion techniques such a set forth in U.S. Pat. Nos. 3,706,344; 3,871,448; and 4,194,577 can be carried out by employment of the present method and apparatus.

One of the unforeseen advantages of the present invention lies in the reliability of all of the shaped charges to be downwardly oriented in boreholes which slope as little as 45° relative to the vertical. An unexpected result attained in completing a well with the present invention is in the relatively high producton rate achieved from a very thin payzone due to the multiplicity of downwardly directed perforations formed with the gun. Although each individual perforation is very small, the large number of perforations jointly provide a significant production rate. Furthermore, because of the large number of perforations, the rate of flow through the performations may be slow enough that sand particles from the formation are not carried upwardly into the casing.

Any number of different journal means can be used for balls 152 or wheels 52 and 70. Moreover, it is possible to employ a wireline in lieu of the tubing 36 where the hole is not unduly slanted. The gun will gravitate into proper firing position, and can be detonated electrically.

The shaped charges can be spaced any desired distance apart, and grouped in various different patterns. Extremely large casing guns can be used in the present invention.

While a preferred embodiment of the invention has been shown and described, modifications thereof can be made by one skilled in the art without departing from the spirit of the invention.

I claim:

1. A tubing conveyed perforating gun assembly for connection to a tubing string to enable the gun to be run downhole into a slanted borehole and detonated in order to perforate the wall of the borehole in a predominantly downward direction including:

a housing secured to said tubing string;

a charge carrier having a plurality of shaped charges therein oriented to fire in a pattern encompassing less then 180 degrees;

a gun firing head connected to detonate the shaped charges of the charge carrier;

means for actuating the gun firing head; and spaced journal means supporting said charge carrier in low friction relationship relative to the housing;

wherein the center of gravity of said charge carrier is displaced from the axis of said journal means in the direction of said firing pattern to cause said shaped charges to gravitate into a position which orients the charges predominantly downwardly so that the penetration, when the charges are detonated, occurs in a downward direction and said charge carrier is received within the housing which, in turn, isolates said charge carrier and said journal means from the wellbore.

2. The gun assembly of claim 1 wherein said journal means includes longitudinally spaced groups of rollers, each group including a plurality of radially spaced rollers.

3. The gun assembly of claim 1 wherein said charge carrier is received within the housing which isolates said charge carrier and said journal means from the wellbore and including a gun firing head connected to detonate the shaped charges of the charge carrier; and means for actuating the gun firing head.

4. The gun assembly of claim 1 wherein said charge carrier is circular in cross-sectional configuration; there being an access hole formed in opposition to two charge containing ports with the ports being of a size to receive a shaped charge therein, said access hole and said ports being radially spaced from one another.

5. The gun assembly of claim 3 wherein said charge carrier is triangular in cross-sectional configuration, and said journal means includes spaced groups of rollers, each group includes three radially spaced rollers, there being a plurality of gun housings spaced apart from one another by groups of rollers.

6. A perforating gun for use downhole in a slanted borehole, said gun including:

a housing;

a charge carrier contained within the housing having a plurality of shaped charges mounted thereon, with the charges being oriented with respect to one another to fire radially away from the gun within an angle of less than 180° divergence;

journal means by which said charge carrier is supported for rotation within the housing, said journal means being positioned with respect to the center of gravity of the charge carrier to cause the charge carrier to gravitate into a position in which said shaped charges are oriented to perforate in a predominantly downward direction;

means for detonating said shaped charges;

a gun firing head connected to said housing to detonate said means for detonating said shaped charges of the charge carrier; and means for actuating the gun firing head wherein said charge carrier is received within the housing so that said charge carrier and said journal means are isolated from the wellbore.

7. The gun of claim 6 wherein said journal means includes spaced groups of rollers, each group includes a plurality of radially spaced rollers, there being a plurality of gun housings spaced appart from one another by groups of rollers; and, means for running the gun into and out of the slanted borehole.

8. The gun of claim 6 wherein said charge carrier is circular in cross-sectional configuration; there being an access hole formed in opposition to two charge containing ports with the ports being of a size to telescopingly receive a shaped charge therein, with said access hole and ports being radially spaced from one another.

9. The gun of claim 6 wherein said charge carrier is triangular in cross-sectional configuration, and said journal means includes spaced groups of rollers, each group includes three radially spaced rollers, there being a plurality of gun housings longitudinally spaced apart from one another by groups of rollers.

10. The gun of claim 6 including a plurality of charge carriers connected together and to a gun firing head, and means connecting said gun firing head to a tubing string so that the shaped charges can be positioned downhole on the end of the tubing string, and the gun detonated by running a detonation means downhole through the tubing string to the gun firing head.

11. Method of orienting the shaped charges of a perforating gun having a housing to cause the charges thereof to fire radially away from the gun in a predominately downward direction respective to the horizontal when the gun is used downhole in a slanted borehole, comprising the steps of:

(1) arranging shaped charges within a charge carrier so that the charge carrier can be axially rotated to a position which orients the charges to penetrate the borehole wall in a downward direction;

(2) connecting a plurality of journal means in spaced relationship along the length of the gun so that the charge carrier of said gun is supported for low friction axial rotation with respect to said housing of said perforating gun placing a plurality of rollers circumferentially about the charge carrier; and placing the charge carrier within said housing so that one of the rollers of the plurality of rollers supports the charge carrier from the inside peripheral wall of said housing;

(3) arranging the journal means, charge carrier, and shaped charges with respect to one another to cause the center of gravity of the charge carrier to be located below the geometrical center of the charge carrier; and (4) running the gun downhole into said slanted borehole; positioning the gun adjacent a formation; and detonating the shaped charges so that the lower wall of the borehole is perforated and production from the formation flows up through the perforations and into the wellbore.

* * * * *